US012396527B2

(12) United States Patent
Heinz

(10) Patent No.: US 12,396,527 B2
(45) Date of Patent: Aug. 26, 2025

(54) JEWELRY PIECE

(71) Applicant: Joerg Heinz GmbH & Co. KG, Neulingen (DE)

(72) Inventor: Martin Heinz, Neulingen (DE)

(73) Assignee: Joerg Heinz GmbH & Co. KG, Neulingen (DE)

( * ) Notice: Subject to any disclaimer, the term of this patent is extended or adjusted under 35 U.S.C. 154(b) by 0 days.

(21) Appl. No.: 18/460,685

(22) Filed: Sep. 4, 2023

(65) Prior Publication Data

US 2023/0404223 A1 Dec. 21, 2023

Related U.S. Application Data

(63) Continuation of application No. PCT/EP2022/025090, filed on Mar. 8, 2022.

(30) Foreign Application Priority Data

Mar. 8, 2021 (DE) ..... 10 2021 001 206.2

(51) Int. Cl.
*A44C 5/00* (2006.01)

(52) U.S. Cl.
CPC ..... *A44C 5/0069* (2013.01)

(58) Field of Classification Search
CPC ... A44C 5/0076; A44C 5/0069; A44C 5/0061; A44C 5/0053; A44C 5/0084; A44C 5/0092
See application file for complete search history.

(56) References Cited

U.S. PATENT DOCUMENTS 237,344 A * 2/1881 Vester ..... A44C 5/12 63/8
407,566 A * 7/1889 Ballou ..... A44C 5/0076 59/79.2
1,069,254 A * 8/1913 Henning ..... A44C 17/0208 63/29.1
1,140,445 A * 5/1915 Collingwood et al. ..... A44C 5/0061 63/5.1

(Continued)

FOREIGN PATENT DOCUMENTS

DE 7412877 U 12/1974
FR 1154138 A * 4/1958
GB 191505609 A * 11/1915

*Primary Examiner* — Jason W San
*Assistant Examiner* — Anna S Rashid
(74) *Attorney, Agent, or Firm* — Orbit IP, LLP; Marc G. Martino

(57) ABSTRACT

An item of jewelry has a main body with a first and second end, which, in the closed state, is located opposite the first end. The main body defines a through-opening and the two ends of the main body can be moved away from one another to form a through-opening. The main body has a channel, in which at least one resiliently elastic element is movably arranged. The first end of at least one connecting element is fastened directly or indirectly on the first end of the main body, and which extends over a free space between the first and the second ends of the main body in the open state. When the first and second ends of the main body are moved apart the resulting activation of the resiliently elastic element generates a restoring force which moves the two ends of the main body towards one another.

15 Claims, 9 Drawing Sheets

(56) References Cited

U.S. PATENT DOCUMENTS 1,526,702 A * 2/1925 Feid ..... A44C 5/0069 63/3
1,744,206 A * 1/1930 Bopp ..... A44C 5/0076 63/11
1,807,440 A * 5/1931 Schraysshuen ..... A44C 5/0076 63/3
2,270,216 A * 1/1942 Marwil ..... A44C 5/0069 224/175
2,554,629 A * 5/1951 Meyer ..... A44C 11/002 63/3
2,600,232 A * 6/1952 Feid ..... A44C 5/0069 D11/4
2,639,067 A * 5/1953 Hirsch ..... A44C 5/0069 224/174
2,695,740 A * 11/1954 Kolbe ..... A44C 5/0069 224/175
2,751,132 A * 6/1956 Myerson ..... A44C 5/0069 224/175
3,136,139 A * 6/1964 Sinner ..... A44C 5/0076 224/175
3,580,438 A * 5/1971 Raval ..... A44C 5/04 63/11
3,693,375 A * 9/1972 Paulsen ..... A44C 5/0069 224/175
5,823,409 A * 10/1998 Kennedy ..... A44C 5/22 24/301
2005/0083788 A1* 4/2005 Ogletree ..... A44C 5/0069 368/282
2009/0120130 A1* 5/2009 Mabra ..... A44C 5/22 63/3.1
2014/0113095 A1* 4/2014 Xu ..... A44C 5/0069 428/37
2015/0335108 A1* 11/2015 Chiarini ..... A44C 15/005 29/896.41
2016/0345690 A1* 12/2016 Scandolaro ..... A44C 5/0076
2020/0329831 A1* 10/2020 Kubiak ..... A44C 5/20
2021/0298432 A1* 9/2021 Picchiotti ..... A44C 5/0084
2024/0156217 A1* 5/2024 Aivaz ..... A44C 5/22

* cited by examiner

JEWELRY PIECE

CROSS-REFERENCE TO RELATED APPLICATIONS

This continuation application claims priority to PCT/EP2022/025090 filed on Mar. 8, 2022, which has published as WO 2022/189037 A1 and also the German application number 10 2021 001 206.2 filed on Mar. 8, 2021, the entire contents of which are fully incorporated herein with these references.

FIELD OF THE INVENTION

The invention relates to a piece of jewelry with a base body having a first end and a second end arranged oppositely to the first end in a close state of the piece of jewelry, the base body defining a passage opening and the two ends of the base body can be moved away from each other to form a widened passage opening which is wider than the passage opening, the base body having a channel in which at least one resilient element is movably arranged.

BACKGROUND OF THE INVENTION

Such a piece of jewelry is known and is used as a wrist band or arm hoop, foot band or foot hoop or neck band or neck hoop, in order just to name a few examples. Such pieces of jewelry surround the corresponding body part of the carrier more or less tightly when worn, so that for a removal or for an application of the piece of jewelry a clasp has got to be opened and the two ends of the piece of jewelry being arranged oppositely to each other in the closed stated must be moved away from one another, thereby creating a passage opening which is large enough for the respective body part, e.g., arm, foot or neck of the carrier, to move through it. The known piece of jewelry has, on its first end, a closing element of a clasp and on its second end a closing element formed complementary to the first closing element. After the piece of jewelry has been applied, this clasp has got to be closed in order to enable a secure wearing of the piece of jewelry. This is not simple, in particular, in the case of filigree jewelry pieces with a tiny clasp, since, in order to close the piece of jewelry, the first closing element must be inserted into the second closing element complementary to the first closing element.

The German patent document DE 74 12 877 U discloses a stretchable watch strap which has two rigid brackets which are mounted pivotably on a watch housing and which are hollow in order to create a receiving space for accommodating a connecting member forming a connecting bridge between the brackets, wherein a spring-like retraction device is arranged in the receiving space of the brackets between one of the ends of the receiving space and one of the ends of the connecting member. The connecting element consists of a cord or a pliable band, has a stop at each of its ends and is slidable in the interior of the two brackets. It extends over the entire length of the brackets. Each of these brackets has a compression spring which is arranged coaxially to the flexible cord and which, in its closed position, loads the two brackets. One end of each spring supports on a traverse wall of the respective rigid bracket, which has an opening the cross section of which corresponds to the form and dimension of the pliable band. With its other end, each compression spring rests on a stop of the pliable cord. A first end of each bracket is attached to one side of the watch case via a hinge and each of the two compression springs provided in one bracket each therefore extends from the end of the respective bracket facing the watch case to the other end of the bracket and is connected there to one end of the connecting member. By pulling apart the two second ends of the two brackets articulatedly connected to the watch case a passage opening defined by the watch strap can be enlarged.

SUMMARY OF THE INVENTION

It is the object of the present invention to further develop a piece of jewelry of the type mentioned at the beginning in such a way that a closing of the piece of jewelry is facilitated.

This object is solved by a piece of jewelry characterized in that the channel of the base body extends from the first end to the second end of the base body, and that the piece of jewelry comprises at least one connecting element, the first end of which is attached directly or indirectly to the first end of the base body, extends across a space being present between the first end and the second end of the base body in its opened state and engages with its second end one end of the resilient element in such a way that, when the first and the second ends of the base body are moved apart from each other to form a widened passage opening, by the therefrom resulting loading of the resilient element a restoring force causing the two ends of the base body to move towards each other can be generated.

By means of the measures according to the invention in an advantageous way a piece of jewelry is created allowing a closing of the piece of jewelry without a clasp. Since it is provided according to the invention that by means of the resilient element a restoring force is created, which causes the two ends of the base body to move towards each other, the closing, i.e., the bringing together of the two ends of the base body, is achieved "automatically", and a separate clasp, which is up to now required in the case of known pieces of jewelry is in an advantageous way manner no longer necessary.

Advantageous developments of the invention are the subject matter of the dependent claims.

Further details and advantages of the invention can be gathered from the exemplary embodiments, which are described below with reference to the figures. They show:

DETAILED DESCRIPTION OF EMBODIMENTS OF THE INVENTION

Figure 1:
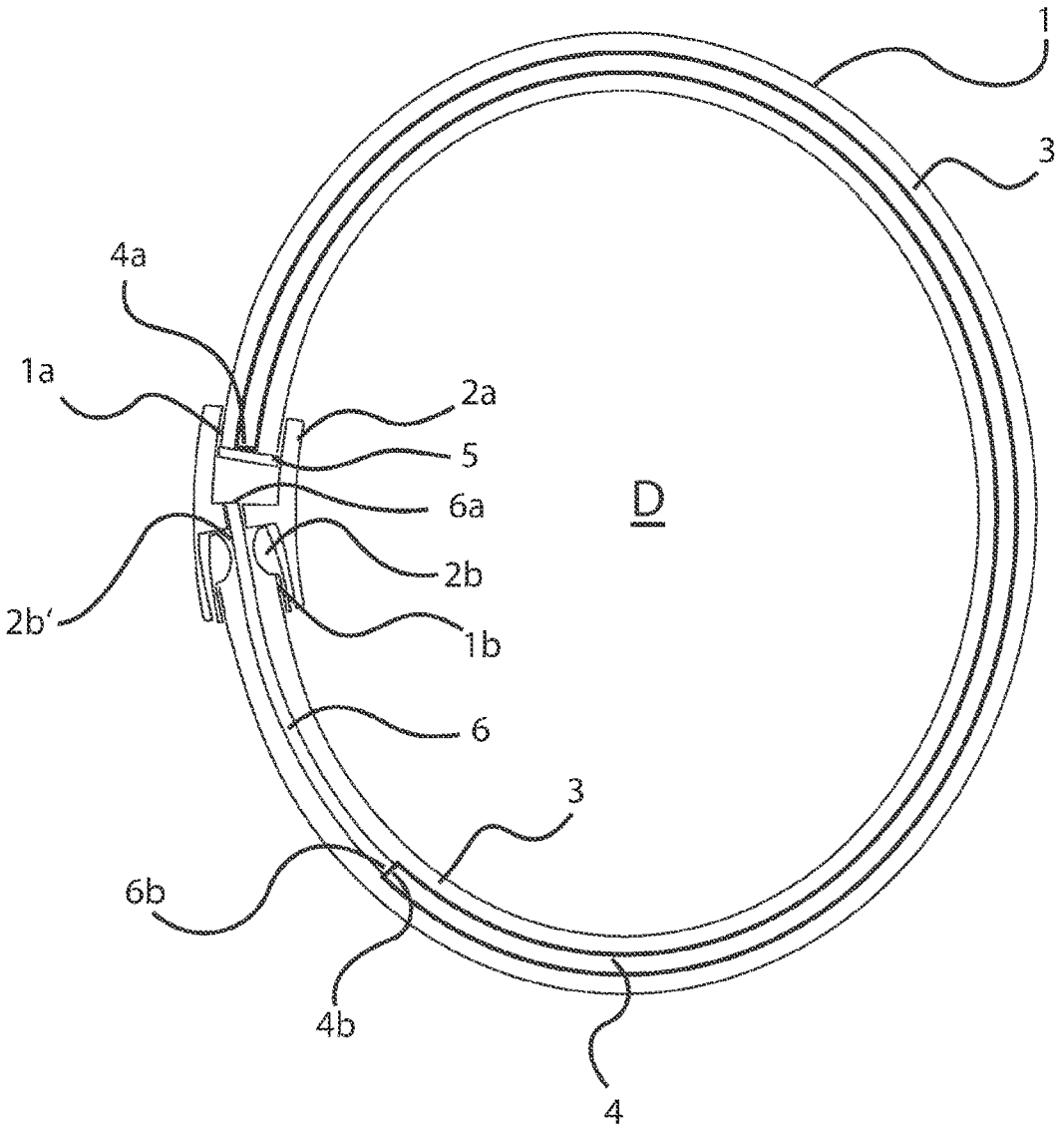
FIG. 1 illustrates a section through a first embodiment of a piece of jewelry in its closed state.
Figure 2:
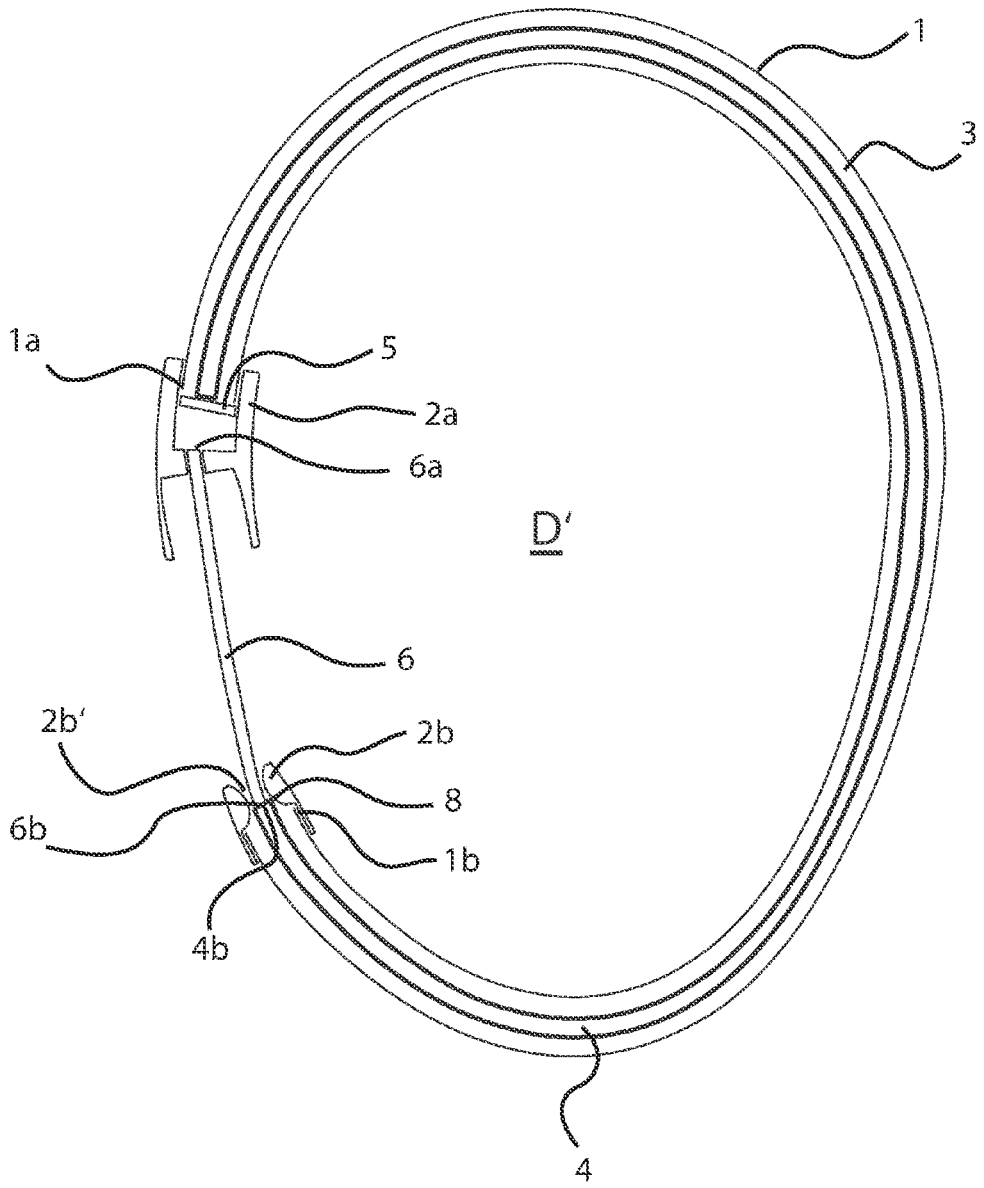
FIG. 2 illustrates a section through the embodiment according to FIG. 1 in its opened state.

FIGS. 1 and 2 show a first exemplary embodiment of a piece of jewelry, which has a base body 1 having a first end

1*a* and a second end 1*b* being arranged opposite to the first end 1*a* in a closed state of the piece of jewelry. The base body 1 defines a passage opening D of the piece of jewelry, through which its wearer can lead through a respective body part, e.g., an arm, a foot or its neck, in order to apply or remove the piece of jewelry. For opening, i.e., enlarging the passage opening D to an widened passage opening D', the two ends 1*a* and 1*b* of the base body 1, which are preferably designed flexible, are moved away from each other, so that the widened passage opening D' is formed, which allows that the wearer of the described piece of jewelry to apply it or to take it off by moving the body part of the carrier, i.e., an arm of the wearer, through said widened passage opening D'. In the following description it is assumed that the piece of jewelry is designed as a piece of jewelry designated to be worn on an arm of the wearer. However, it is apparent to a person skilled in the art from the following description that the piece of jewelry described is not limited to this application. Rather, the measures explained below are also applicable to a foot hoop or a foot band or a neck band, just to name a few examples, in which, for the application of the piece of jewelry a body part of the wearer is to be moved through the ends 1*a*, 1*b* of the base body 1 into the interior of the piece of jewelry, and for taking off the piece of jewelry is moved in a reverse direction from the inside to the outside. Such a piece of jewelry is known and therefore needs not to be described in more detail.

In order to enable a simplified and therefore more comfortable application or removal of the piece of jewelry, the following measures are proposed:

The base body 1 of the piece of jewelry has a channel 3 in which a resilient element 4, which is designed here as a tension spring, is arranged movably. In the exemplary embodiment described here, the channel 3 extends over the entire length of the base body 1, i.e., from the first end 1*a* to the second end 1*b*. The resilient element 4 is fixedly connected with its first end 4*a* to a stop 5 arranged in a stationery manner in the piece of jewelry or bears against this stationery stop 5.

The base body 1 is preferably designed as a sheath or a hose. It is apparent to the person skilled in the art that the afore-mentioned embodiments for the base body 1 only have an exemplary character. Rather, it is, e.g., possible to provide the base body 1 as a stocking braid. Essential is only that the base body 1 of the piece of jewelry is designed in such a way that the two ends 1*a*, 1*b* can be moved away from each other for forming the afore described passage openings D and D' respectively and, for closing the piece of jewelry, can be moved towards one another.

The piece of jewelry has a connecting element 6 which extends between the two ends 1*a*, 1*b* of the base body 1, which is with its first end 6*a* connected to the first end 1*a* of the base body 1 directly or indirectly. The connecting element 6 is preferably non-stretchable. However, it is possible that the connecting element 6 is designed stretchable. Preferably, it is provided that the connecting element 6 is designed as a cable or a strand.

In the exemplary embodiment described here the first end 6*a* of the connecting element 6 is connected indirectly to the base body 1. It is connected to a decorative element 2*a* surrounding the first end 1*a* of the base body 1. The decorative element 2*a* serves to cover the end 1*a* of the base body 1. Said decorative element 2*a* is not essential for the subsequently described moving together of the ends 1*a*, 1 *b*.

But it has got to be noted that this is not mandatory; it is also possible to connect the first end 6*a* of the connecting element 6 to the base body 1 directly or indirectly. Essential is only that the connecting element 6 is connected with its first end 6*a* directly or indirectly, (e.g., via the first decorative element 2*a*) to the or at the first end 1*a* of the base body 1.

A second element 6*b* of the connecting element 6 is connected to the second end 4*b* of the resilient element 4. In the exemplary embodiment described, a second decorative element 2*b* is provided which surrounds the second end 1*b* of the base body 1 and comprises a passage 2*b*' through which the connecting element 6 can be led through. It is preferred that the passage 2*b*' is configured in such a way that a stop 8 for the second end 4*b* of the resilient element 4 is provided, so that in the case of the opening movement of the piece of jewelry described below the second end 4*b* is not moved out of the base body 1.

A comparison of FIGS. 1 and 2 now shows the adjustment of the length of the connecting element 6 and the resilient element 4: FIG. 2 shows the piece of jewelry in its opened position. In the latter, the second end 4*b* of the resilient element 4 abuts at the stop 8. In the case of a non-stretchable connecting element 6, which is preferably used, the ends 1*a*, 1*b* of the base body 2 now cannot be moved further away from each other, since the non-stretchable connecting element 6 prevents this. The length of the connecting element 6 is thus preferably selected in such a way that the maximum distance between the two ends 1*a*, 1*b* of the base body 1 is defined in this way. In the closed state, as it is shown in FIG. 1, the two ends 1*a*, 1*b* are adjacent to one another, that is, to say in this state they have their smallest structurally predetermined distance from one another. Since it is preferred that in this state the resilient element 4 is in its relaxed state, it follows therefrom that the length of the resilient element 4 is adjusted to the length of the connecting element 6 as well as the design of the clasp 2 so that in the closed state of the piece of jewelry the resilient element 4 is in its relaxed state or slightly preloaded.

In the exemplary embodiment described it is also provided that the resilient element 4 essentially extends over the entire length of the base body 1, i.e., from the stop 5 at the first end 1*a* of the base body 1 to the position described above. But this is not mandatory, for example it is possible that the stop 5 is not provided at the first end 1*a*, but distant therefrom in the direction of the channel 3, e.g., in the middle of the base body 1. This has got the advantage that a correspondingly shorter resilient element 4 can be used.

FIG. 1 now shows the piece of jewelry in its closed state. The two ends 1*a*, 1*b* of the base body 1 are adjacent to one another, the piece of jewelry surrounds the respective body part of the wearer more or less tightly. In order to open the piece of jewelry and bring it in its position shown in FIG. 2, the piece of jewelry is opened by its wearer by moving away from each other the two ends 1*a*, 1 *b*. Since—as described before—the first end 1*a* of the piece of jewelry and the second end 4*b* of the resilient element 4 are connected via the connecting element 6, which is preferably non-stretchable, the moving apart of the ends 1*a* and 1*b* of the base body 1 causes the resilient element 4—as it is shown by a comparison of FIGS. 1 and 2—to expand. As a result, a restoring force is built up.

FIG. 2 now shows the piece of jewelry in its opened position, the two ends 1*a* and 1*b* of the base body 1 are spaced apart so far from each other that through the widened passage opening D' formed in that way the corresponding body part of the wearer can be led through. The piece of jewelry therefore can be applied or removed in said position. When the wearer releases one or both ends 1*a*, 1*b* of the base body 1 of the piece of jewelry, the restoring force created by the resilient element 4 causes that tension spring to contract with the effect that the second end 1*b* of the base body 1 is moved towards the first end 1*a* by the connecting element 6, so that the ends 1*a* and 1*b* of the base body 1 move towards one another. At the end of this closing movement the two ends 1*a*, 1*b* of the base body 1 are adjacent again, so that the piece of jewelry has been closed "automatically". By means of the described measures, in an advantageous way a simplified opening and closing of the piece of jewelry is achieved.

If the piece of jewelry is closed as described above, the second decorative element 2*b* dips into the sleeve-shaped first decorative element 2*a*. Such a measure has got the advantage that in this way an optically high-quality design of the ends 1*a*, 1*b* of the base body 1 of the piece of jewelry is achieved, since now no longer—as it would be technically sufficient—the two ends 1*a*, 1*b* lie "naked" next to one another.

Figure 3:
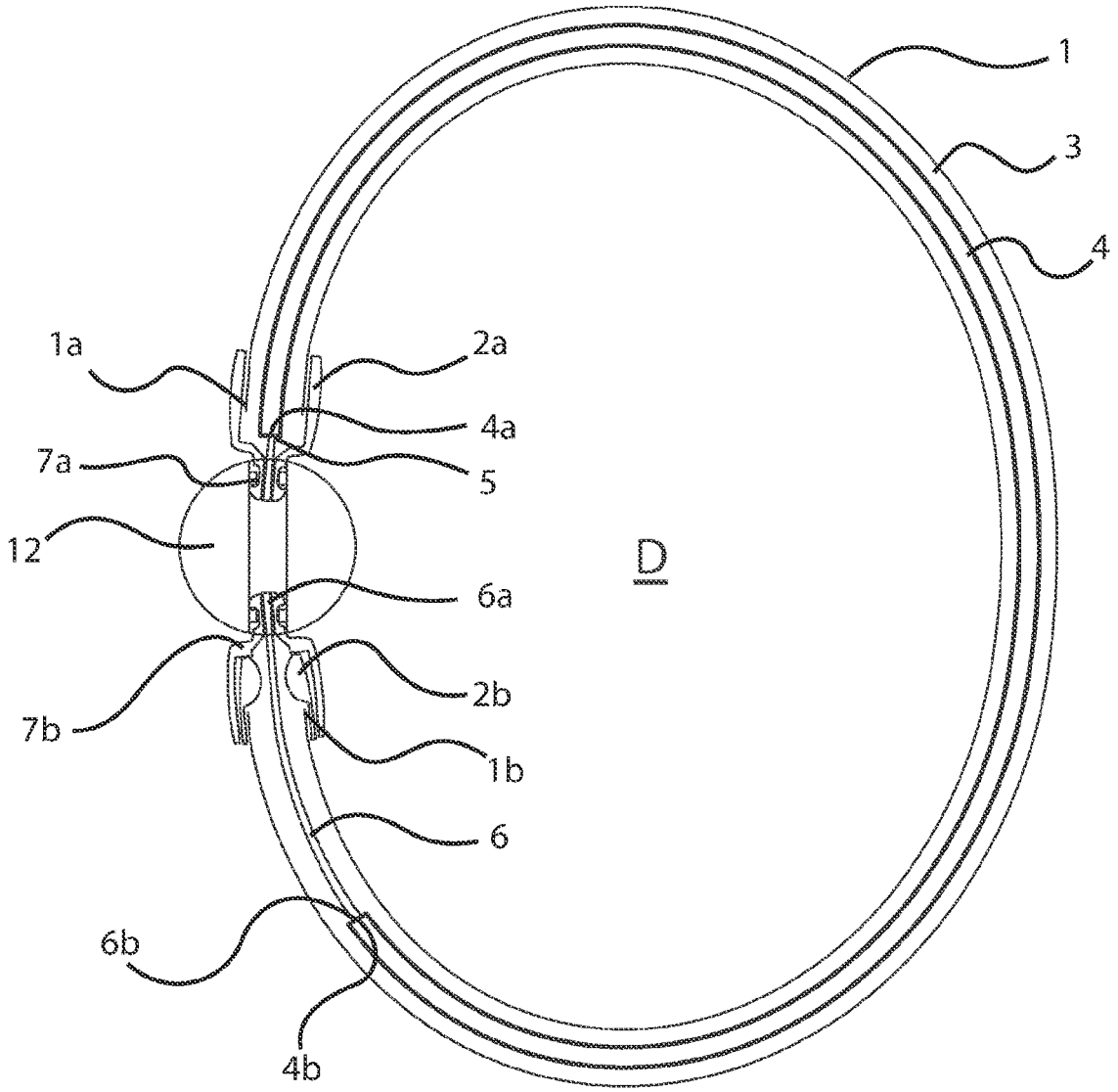
FIG. 3 illustrates a section through a second embodiment of a piece of jewelry in its closed state.
Figure 4:
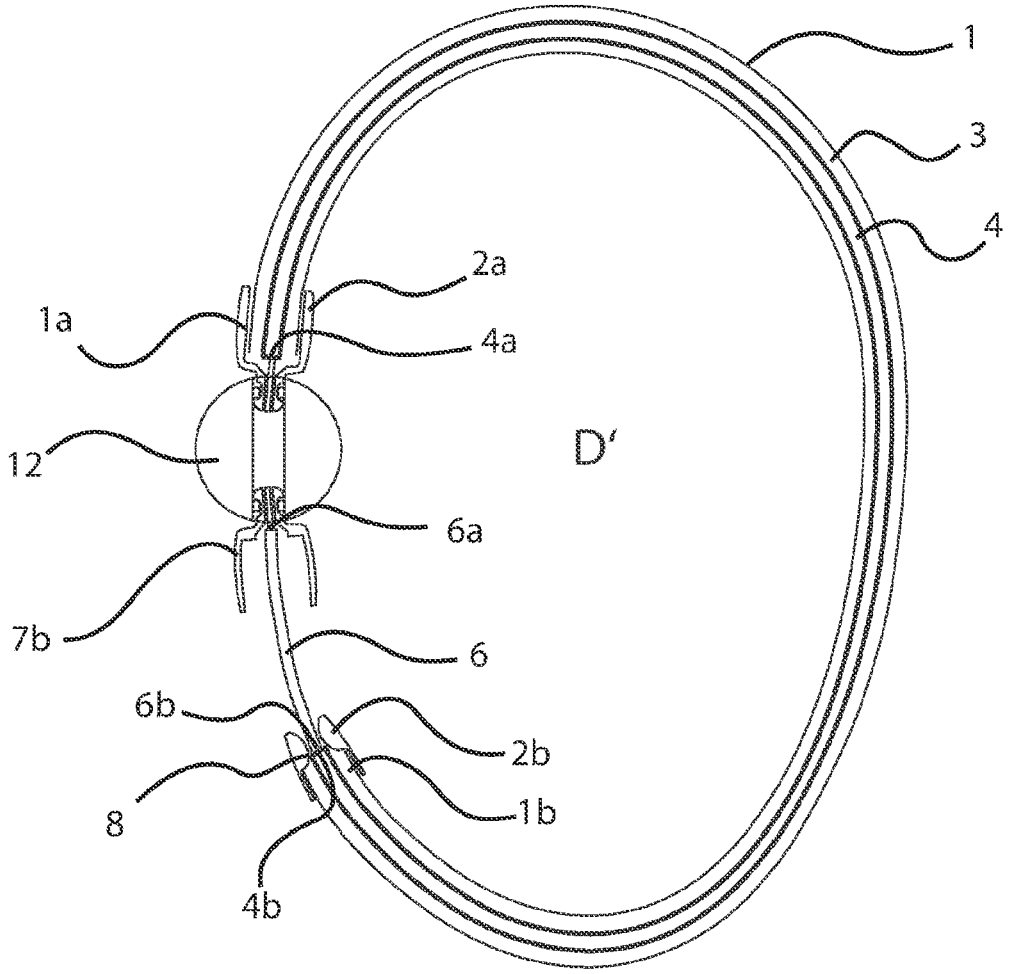
FIG. 4 illustrates a section through the embodiment according to FIG. 3 in its opened state.

FIGS. 3 and 4 now shows a second exemplary embodiment, which corresponds in its basic structure to the one of the first exemplary embodiment, so that corresponding components are provided with the same reference numerals and are not explained with regard to their structural design and their modes of operation once more. The main difference between the two embodiments is the attachment of the connecting element 6 to the first end 1*a* of the base body 1. While in the first exemplary embodiment it is provided that the first end 6*a* of the connecting element 6 is firmly attached, i.e., non-detachable, to the first end 1*a* of the base body 1 directly or indirectly, it is provided in the second embodiment that the first end 6*a* of the connecting element 6 can be detached from the base body 1. For that purpose, an exchangeable decorative element 12 is provided, which is arranged adjacent to the first end 1*a* of the base body 1. In the example shown here the exchangeable decorative element 12 is provided as a spherical body. The exchangeable decorative element 12 comprises a first closing element 7*a* which interacts with the first decorative element 2*a* and allows a releasable connection between the first decorative element 2*a* and the exchangeable decorative element 12. In a corresponding manner, on the opposite side a second closing element 7*b* is provided, which cooperates with the second decorative element 2*b*, which is arranged at the second end 1*b* of the base body 1.

Figure 5:
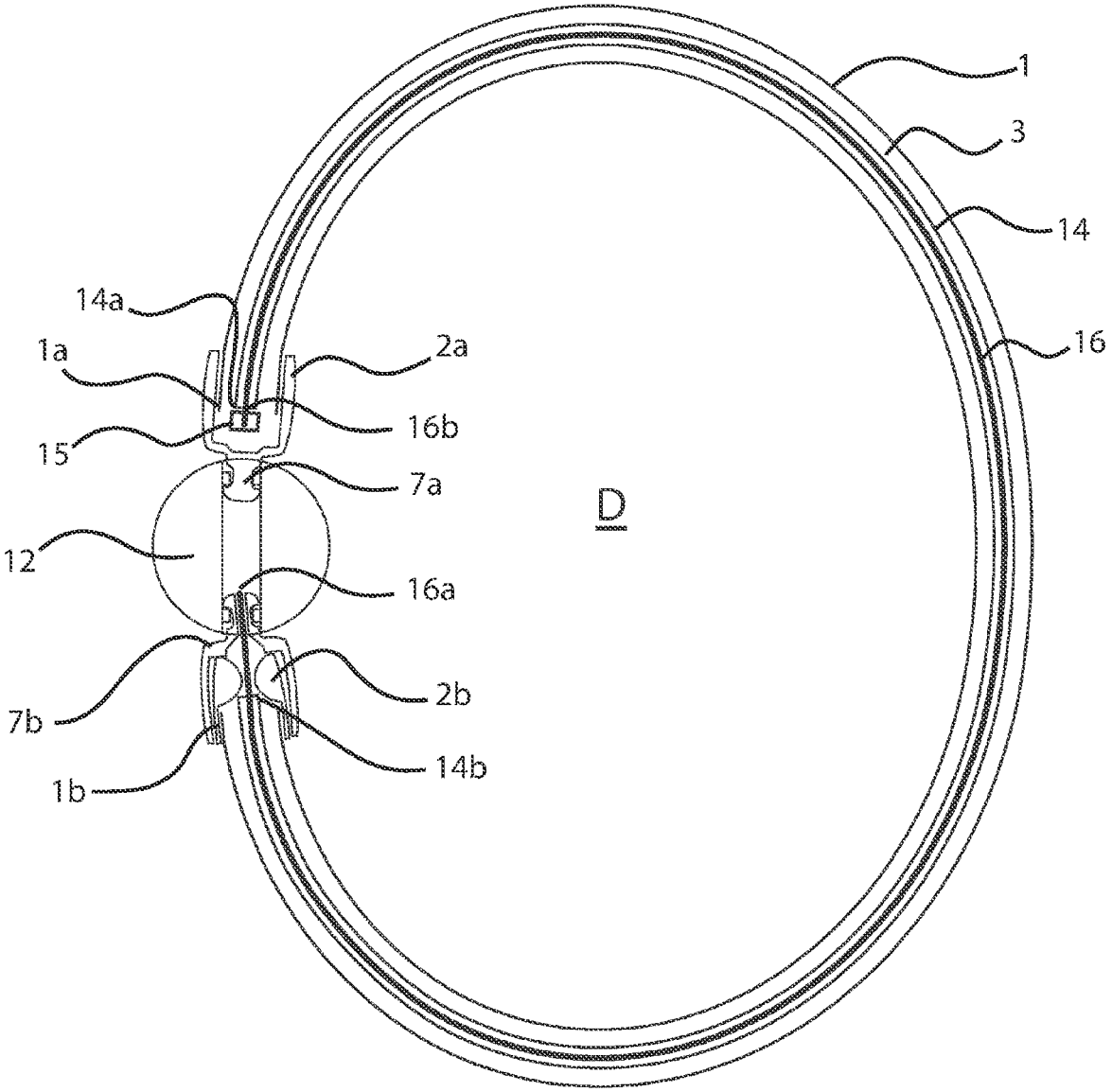
FIG. 5 illustrates a section through a third embodiment of a piece of jewelry in its closed state.
Figure 6:
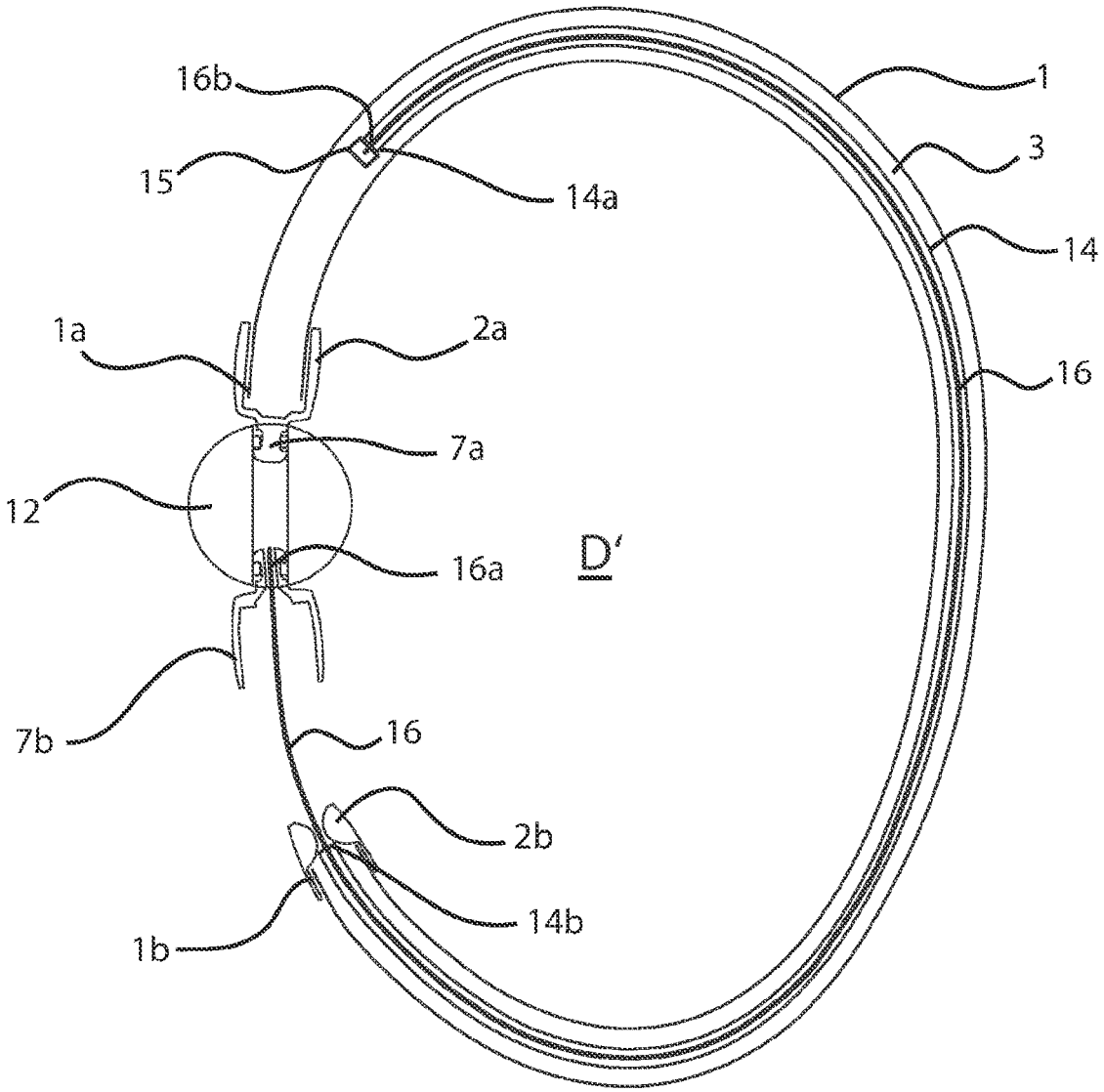
FIG. 6 illustrates a section through the embodiment according to FIG. 5 in its opened state.

In FIGS. 5 and 6 a third exemplary embodiment is shown, whose basic structure in turn corresponds to the one of the first two exemplary embodiments, so that corresponding components are provided with the same reference numerals and are no longer described with regard to their structural design and their mode of operation. The main difference between the second exemplary embodiment and this embodiment is that in the third exemplary embodiment, instead of the resilient element 4 acting as a tension spring, a resilient element 14 acting as a compression spring is provided. The resilient element 14 once more extends in channel 3 of the base body 1 from its first end 1*a* to its second end 1*b*. In the region of the first end 1*a* a stop 15 corresponding to the stop 5 for a first end 14*a* of the resilient element 14 is provided. In the third exemplary embodiment the stop 15 is not—as the stop 5 of the first two exemplary embodiments—arranged stationery in the base body 1, but—as a comparison of FIGS. 5 and 6 shows—arranged movably in the base body 1 and, in particular, in channel 3. The stop 15 is connected with a second end 16*b* of a connecting element 16 corresponding to the connecting element 6, whereby a first end 16*a* is connected to a first end 1*a* of the base body 1 directly or—as in the present embodiment—indirectly via the exchange decorative element 12, so that by pulling on the connecting element 16—as described below—the stop 15 can be displaced in the channel 3 of the base body 1. Such a measure has the design advantage that in the case of a compression spring the respective end therefore needs not to be—as in the case of the first exemplary embodiment—necessarily fixed to the stop 15 firmly. A further difference between the second and third embodiment following from the afore-mentioned measures is that the connecting 16 does not—like in the first and second embodiment—extend from the first end 1*a* of the base body 1 to the second end 4*b* of the resilient element 4, but it is provided that the connecting element 16 of the third exemplary embodiment extends to the stop 15, wherein it is preferred that the connecting element 16 and the resilient element 14 are guided coaxially, that is to say that the connecting element 16 here preferably runs in the interior of the resilient element 14.

FIG. 5 now shows the closed state and FIG. 6 shows the opened state of the piece of jewelry. In the closed state the resilient element 14 is unloaded or has a slight preloading. In order to now open the piece of jewelry, the wearer moves the two ends 1*a* and 1*b* of the base body 1 of the piece of jewelry apart from each other. Since the second end 16*b* of the connecting element 16 is connected to the stop 15, the moving apart of the ends 1*a* and 1*b* of the base body 1 has got the effect that the connecting element 16 is moved out of the second end 16*b* of the base body 1. This causes the stop 15 connected to the second end 16*b* of the connecting element 16 to move in an axial direction and thus acts on the first end 14*a* of the resilient element 14 and, in the event of a further displacement, compresses the resilient element 14. As a result, a restoring force which drives the ends 14*a* and 14*b* of the resilient element 14 away from each other is generated.

After the piece of jewelry has been moved into its position shown in FIG. 6 and the wearer has moved its arm out of the ring-shaped or bracelet-shaped piece of jewelry and has released one or both ends of the piece of jewelry, the resilient element 14 designed as a compression spring expands, as a result of which the two ends 1*a*, 1*b* are moved towards one another again. The piece of jewelry is thus closed again and the two ends 1*a*, 1*b* of the base body 1 are arranged adjacently.

In the third exemplary embodiment shown in FIGS. 5 and 6 once more an exchange decorative element 12 is used. However, it is apparent to a person skilled in the art from the description above that this is not mandatory here either.

In the three exemplary embodiments described above, it is provided that in each case the second end 1*b* of the base body 1 moves towards the first end 1*a* during the closing process. The first end 6*a* and 16*a* respectively of the connecting element 6 and 16 respectively is—as described—connected to the first end 1*a* directly or indirectly, while the second end 6*b* or 16*b* respectively is in engagement with the resilient element 4 and 14 respectively. In the exemplary embodiments described before, the first end 1*a* of the base body 1 of the piece of jewelry participates in the process of moving together the ends 1*a*, 1*b* by means of the restoring force created by the resilient element 4 and 14 respectively only passively, while the second end 1*b* constitutes the active part of this closing movement. However, it is possible to design the piece of jewelry in such a way that both ends 1*a* and 1*b* are active, that is, to say that not only—like in the first exemplary embodiment—the second end 1*b* approaches the first end 1*a*, but that both ends 1*a* and 1*b* move towards each other when closing the piece of jewelry.

Figure 7:
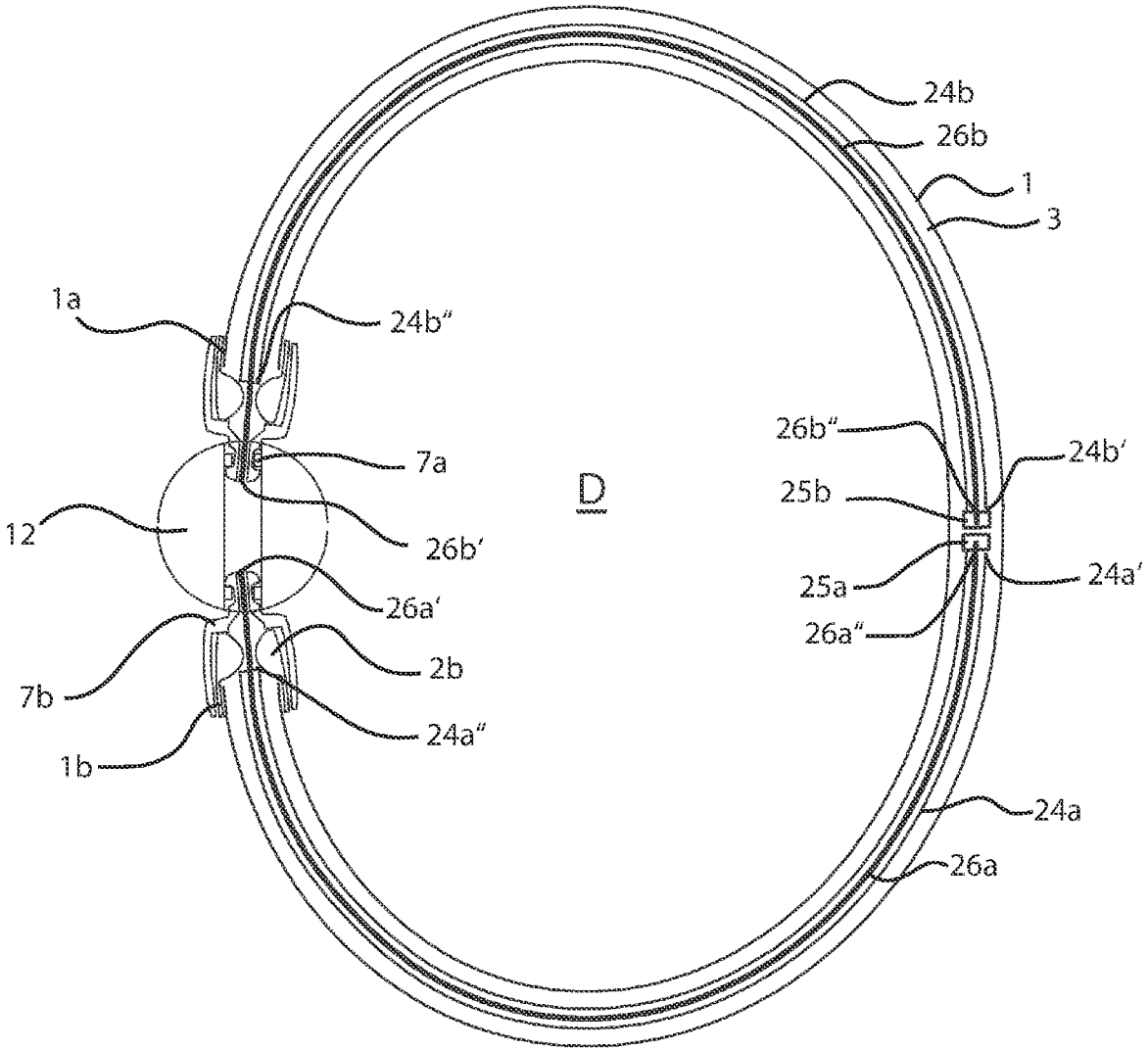
FIG. 7 illustrates a section through a fourth embodiment of a piece of jewelry in its closed state.
Figure 8:
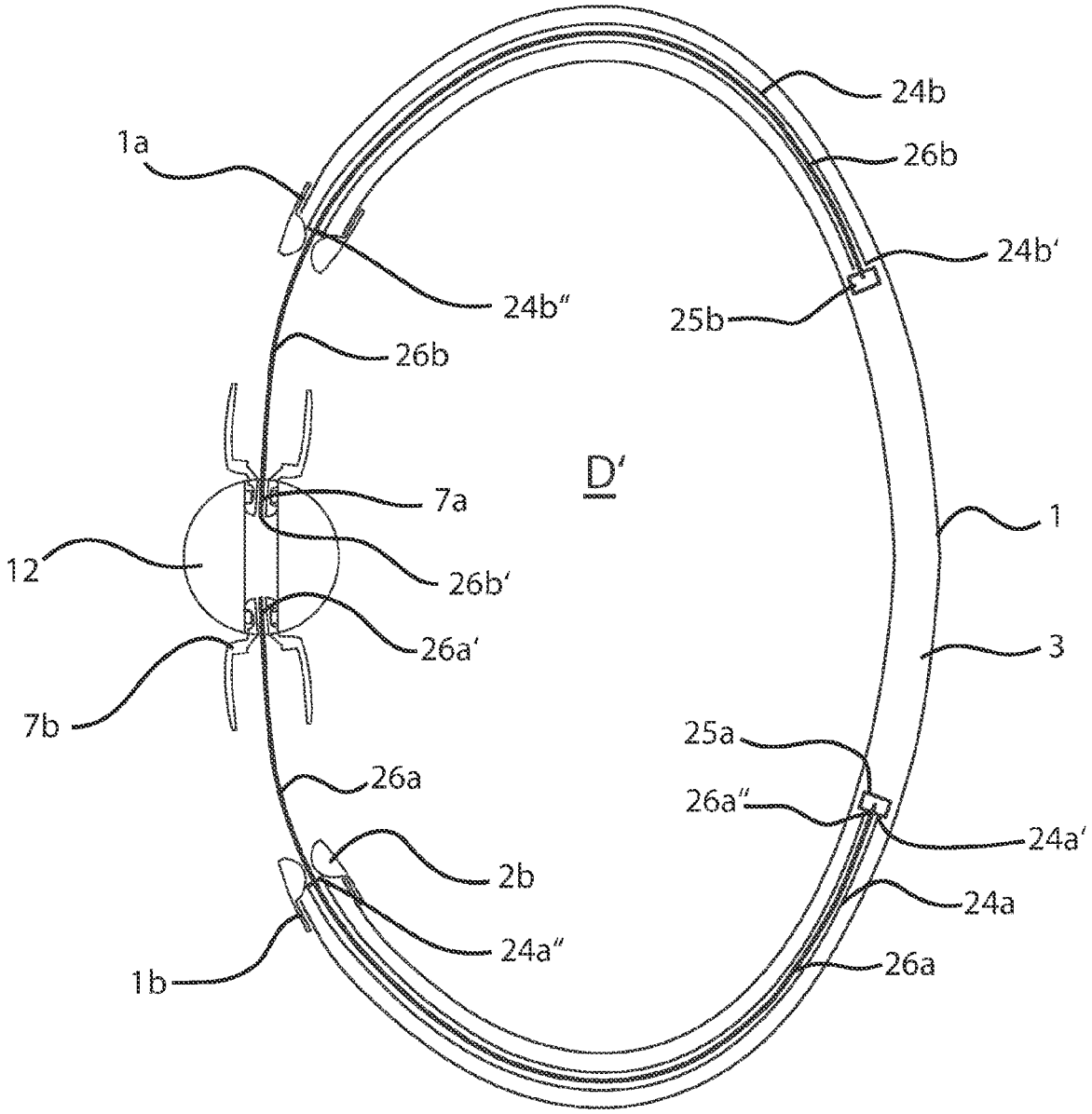
FIG. 8 illustrates a section through the embodiment according to FIG. 7 in its opened state.

A piece of jewelry designed in such a way is now shown in FIGS. 7 and 8 showing a fourth exemplary embodiment. Corresponding components are provided with the same reference numerals and are no longer described in terms of their construction and mode of operation. The design features of the fourth exemplary embodiment can be characterized in that this embodiment the design described for the second end 1*b* in the third exemplary embodiment is also realized in a corresponding manner at the first end 1*a*, that is to say—to put it into a nutshell—the design features as described before for the second end 1*b* are "mirrored" onto the first end 1*a*. The lower part of the piece of jewelry shown in FIGS. 7 and 8 therefore corresponds to the one of the third embodiment, it is therefore not described here once more. FIGS. 7 and 8 show resilient elements 24*a* and 24*b* which now do not extend over the entire length of channel 3, that is to say substantially from the first end 1*a* to the second end 1*b*, but that the resilient element 14 of the third exemplary embodiment is divided into two parts, namely the aforementioned resilient elements 24*a* and 24*b*, so that two resilient elements 24*a* and 24*b* are thus arranged in the channel 3 of the base body 1. In a corresponding manner, the connecting element 16 of the third exemplary embodiment is split into two parts, namely connecting elements 26*a* and 26*b*. In channel 3 thus two resilient elements 24*a* and 24*b* and connecting elements 26*a* and 26*b* are provided. The first connecting element 26*a* and the first resilient element 24*a* correspond in their function and design to the one of the connecting element 16 and the resilient element 14 of the third exemplary embodiment. The first connecting element 26*a* extends from its first end 26*a*', which is directly or via the decorative element 2*b* connected to the second end 1*b* of the base body 1, up to a stop 25*a* corresponding to the stop 15 and is attached to it. The second connecting element 26*b* extends from its first end 26*b*', which is directly or indirectly connected to the first end 1*a* of the base body 1, to a stop 25*b* and its end 26*b*" is connected to the stop 25*b*. If the two ends 1*a*, 1*b* are now moved away from each other during the opening process of the piece of jewelry, this causes—like in the third exemplary embodiment—the connecting element 26*a*, 26*b* to be moved out of the base body 1, so that the stops 25*a* and 25*b* act upon the ends 24*a*' and 24*b*' of the resilient elements 24*a* and 24*b*, causing them to be compressed and each generating a restoring force. If the ends 1*a* and 1*b* are now released, the resilient elements 24*a* and 24*b* expand and thus move the ends 1*a* and 1*b* of the piece of jewelry towards each other.

Figure 9:
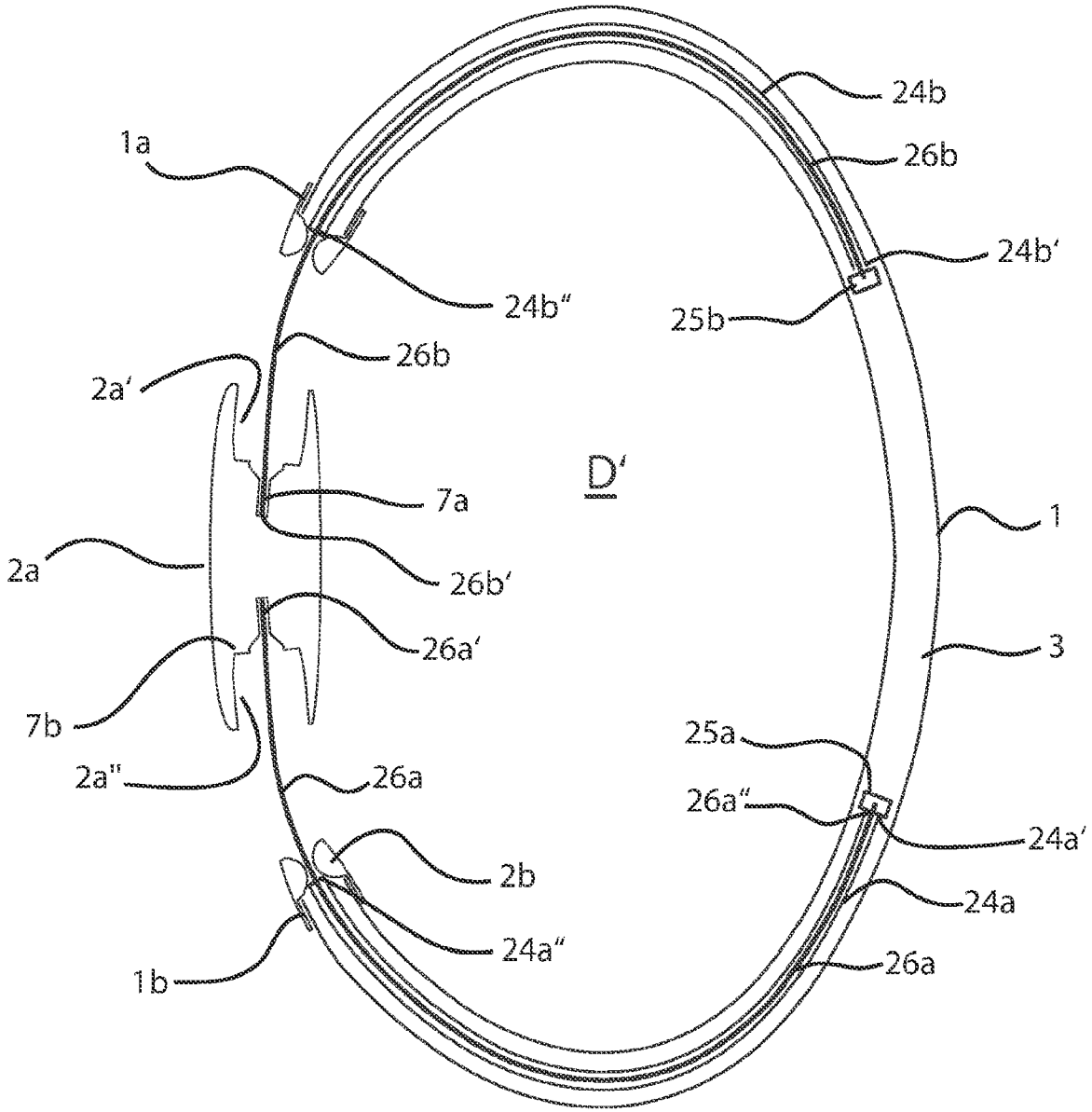
FIG. 9 illustrates a section through the fourth embodiment in its opened state.

In the exemplary embodiment described before it has been assumed again that an exchangeable decorative element 12 is provided between the ends 1*a* and 1 *b*, like in the third embodiment. This is not mandatory, it is also possible to provide the design described before—two resilient elements 24*a*, 24*b*, two connecting elements 26*a*, 26*b*— in a piece of jewelry according to the first embodiment, that is to say in an piece of jewelry not having such an exchangeable decorative element 12. Such a piece of jewelry is shown in FIG. 9 showing a fourth embodiment. In the closed state the first end 1*a* is provided in a first receiving opening 2*a*' of the decorative element 2*a* and the second end 1*b* is provided in a second receiving opening 2*a*" of the decorative element 2*a*.

In summary, it has got to be noted that a piece of jewelry is formed by the described measures which is distinguished by an "automatic closing" of the piece of jewelry. In an advantageous manner, no clasp or a similar closure mechanism is required, since both ends 1*a*, 1*b* are moved via the force of the resilient element 4, 14 and 24*a*, 24*b* respectively in their closed position. Such a measure has got the advantage that the removal and in particular the application of such a piece of jewelry is simplified.

What is claimed is:

1. A piece of jewelry, comprising:

a base body having a first end and a second end arranged oppositely to the first end in a closed state of the piece of jewelry, the base body defining a passage opening in said closed state;

wherein the two ends of the base body can be moved away from one another to enlarge said passage opening to form a widened passage opening;

the base body having a channel in which at least one resilient element is moveably arranged, wherein the channel of the base body extends continuously from the first end to the second end of the base body; and the piece of jewelry having at least one connecting element, a first end of which is non-movably connected directly or indirectly to the first end of the base body;

wherein the at least one connecting element extends across a space being present between the first end and the second end of the base body in an opened state and wherein a second end of the at least one connecting element engages with one end of the resilient element;

wherein, when the first and the second ends of the base body are moved apart from each other to form the said widened passage opening, from the resulting loading of the resilient element a restoring force causing the two ends of the base body to move towards each other is generated.

2. The piece of jewelry according to claim 1, wherein the resilient element is designed as a tension spring, that a first end of the at least one resilient element has a stop arranged stationarily in the piece of jewelry, and that a second end is moveably guided in the channel of the base body and is connected to the moveably guided second end of the at least one resilient element.

3. The piece of jewelry according to claim 1, wherein the at least one resilient element is designed as a compression spring, and that a first end of the at least one resilient element is acting upon a stop being arranged moveably in the base body, that the second end of the at least one connecting element is connected with said stop, and that the first end of the at least one connecting element is connected directly or indirectly with the or on the first end of the base body.

4. The piece of jewelry according to claim 1, wherein in the channel of the base body two resilient elements and two connecting elements are provided, and that the two resilient elements are each designed as a compression spring, that a first end of each of the two resilient elements is acted upon by a stop being arranged moveably in the base body, and that a second end of the corresponding connecting element is connected with an associated stop, and that the first end of the respective connecting element is connected directly or indirectly to or at the first end of the base body.

5. The piece of jewelry according to claim 1, wherein the first end of the at least one connecting element is connected directly to the first end of the base body.

6. The piece of jewelry according to claim 1, wherein the second end of the at least one connecting element is connected to the second end of the base body.

7. The piece of jewelry according to claim 1, wherein the first end of the at least one connecting element is detachably connected directly or indirectly to the first end of the base body.

8. The piece of jewelry according to claim 1, wherein the second end of the at least one connecting element is connected detachably to the second end of the base body.

9. The piece of jewelry according to claim 1, wherein the at least one connecting element is designed non-stretchable.

10. The piece of jewelry according to claim 1, wherein the at least one connecting element is arranged coaxially with the resilient element in the channel of the piece of jewelry.

11. The piece of jewelry according to claim 1, wherein the piece of jewelry comprises a decorative element arranged at the first end of the base body and/or a second decorative element arranged at the second end of the base body.

12. The piece of jewelry according to claim 11, wherein the first decorative element works together with the second decorative element.

13. The piece of jewelry according to claim 1, wherein the piece of jewelry has an interchangeable decorative element.

14. The piece of jewelry according to claim 13, wherein the interchangeable decorative element comprises at least one closing element which interacts with a decorative element arranged on the base body.

15. A piece of jewelry, comprising:

a base body having a first end and a second end arranged oppositely to the first end in a closed state of the piece of jewelry, the base body defining a passage opening in said closed state, wherein the base body extends in a first arcuate direction starting from the first end and extending arcuately to the second end;

wherein the two ends of the base body can be moved away from one another to enlarge said passage opening to form a widened passage opening;

the base body having a channel in which at least one resilient element is arranged, wherein the channel of the base body extends continuously from the first end to the second end of the base body; and the piece of jewelry having at least one connecting element, a first end of which is non-movably connected directly or indirectly to the first end of the base body, and wherein the at least one connecting element extends from the first end of the at least one connecting element in a second arcuate direction that is opposite of the first arcuate direction of the base body;

wherein the at least one connecting element extends across a space being present between the first end and the second end of the base body in an opened state and wherein a second end of the at least one connecting element engages with one end of the resilient element; and wherein, when the first and the second ends of the base body are moved apart from each other to form the said widened passage opening, from the resulting loading of the resilient element a restoring force causing the two ends of the base body to move towards each other is generated.

* * * * *